United States Patent [19]

Iwamoto et al.

[11] Patent Number: 4,825,853

[45] Date of Patent: May 2, 1989

[54] HAND-HELD VIBRATORY MASSAGER

[75] Inventors: Hironori Iwamoto, Japan; Shigeyuki Ikeda, both of Hikone, Japan

[73] Assignee: Matsushita Electric Works, Ltd., Kadoma, Japan

[21] Appl. No.: 82,174

[22] Filed: Aug. 6, 1987

[30] Foreign Application Priority Data

Aug. 20, 1986 [JP] Japan ..... 61-194719

[51] Int. Cl.[4] ..... A61H 1/00

[52] U.S. Cl. ..... 128/36; 128/34

[58] Field of Search ..... 128/36, 35, 34, 32, 128/33

[56] References Cited

U.S. PATENT DOCUMENTS 4,224,932 9/1980 Farb .

4,604,993 8/1986 Moriwaki et al. .

FOREIGN PATENT DOCUMENTS 44-12708 5/1969 Japan .

*Primary Examiner*—Edgar S. Burr

*Assistant Examiner*—Huong Q. Pham

*Attorney, Agent, or Firm*—Armstrong, Nikaido, Marmelstein & Kubovcik

[57] ABSTRACT

A hand-held vibratory massenger has a self-contained applicator head which is resiliently connected to a hand grip for limited movement in substantially all direction relative to the hand grip. A drive motor and an eccentric flyweight are mounted together within the applicator head for making it as a self-contained vibrating unit. The eccentric flyweight is connected to a motor output shaft in an eccentric relation thereto for imparting vibration to the applicator head upon rotation of the output shaft. Also mounted within the applicator head is a counterweight which provides dynamic balancing of the applicator head in such a manner as to align the center of mass of the entire applicator head with that of the flyweight in a plane perpendicular to the center axis of the applicator head.

2 Claims, 4 Drawing Sheets

HAND-HELD VIBRATORY MASSAGER

BACKGROUND OF THE INVENTION

1. Field of the Invention

The present invention relates in general to a hand-held vibratory massager, and more particularly to such a vibratory massager with an applicator head in which a vibration-generating member is mounted together with a drive motor therefor.

2. Description of the Prior Art

As disclosed in Japanese Utility Model publication (KOKOKU) No. 44-12708, there has been already proposed a hand-held vibratory massager with an applicator head mounting therein a drive motor and an eccentric flyweight driven thereby to produce vibration. The applicator head is resiliently supported by means of a coil spring to a hand grip for limited movement in all directions in relation to the hand grip. Such prior massager is found advantageous in eliminating any driving connection between the hand grip and the applicator head, utilizing the weight of the motor itself to increase vibratory energy produced at the applicator head, and in turn reducing the weight of the hand grip for easy manipulation of the massager. However, it poses another problem that the hand grip is likely to suffer from an excessive counter shaking which is a reaction movement transmitted back from the vibrating applicator head through the resiliency of the coil spring, producing fatigue of the user's hand holding the hand grip. This occurs when the center of mass of the flyweight is displaced from that of the entire applicator head in the axial direction thereof. In fact, such displacement is inevitable in the prior art massager because of that the mass center of the entire applicator head is approximately in coincidence with that of the incorporated motor which itself is of heavy construction and accounts for almost all of the weight of the applicator head, and that the flyweight connected to the end of the motor output shaft has its mass center correspondingly offset in the axial direction of the output shaft from the mass center of the motor, or the applicator head. The above problem will be easily understood from FIGS. 5A and 5B, 6A and 6B of the attached drawings in which the applicator head 2 is schematically shown to be coupled to the hand grip 1 by means of the coil spring 3. As shown in these figures, when the mass center Mf of the flyweight is offset by a distance L in the axial direction from the mass center Mc of the entire applicator head 2, a vibratory force F produced at the flyweight being in motion will cause a torque ($F \times L$) about the mass center Mc of the applicator head 2, which torque in turn causes a reaction force to be transmitted back to the hand grip 1 through the resiliency of the coil spring 3, eventually shaking it about the mass center C of the hand grip 1. This occurs equally either the mass center Mf is offset on the opposite side of the mass center Mc from the hand grip 1 (FIGS. 5A and 5B) or it is offset to the hand grip 1 from the mass center Mc (FIGS. 6A and 6B). The above shaking or jerky movement of the hand grip compels the user holding the hand grip to keep it in position against the continuing shaking movement during the massaging process, greatly accumulating fatigue of the user's hand and therefore adversely affecting the performance of the massager.

Other prior massagers which are found to be relevant to the present invention are listed in following.

1. U.S. Pat. No. 4,224,932 issued to Farb;
2. U.S. Pat. No. 4,604,993 issued to Moriwaki et al.

U.S. Pat. No. 4,224,932 (Farb) discloses a massager with an applicator head which is rotatably supported on a rigid drive shaft extending from a hand grip. The applicator head includes an eccentric flyweight bearing which is connected to the drive shaft for rotation in a circular pattern about the drive shaft. The patent neither provides the resilient connection between the applicator head and the hand grip nor discloses the provision of incorporating a drive motor within the applicator head.

U.S. Pat. No. 4,604,993 (Moriwaki et al) discloses a massager in which an applicator head is resiliently supported to a hand grip. But, the applicator head of this patent is designed to be driven by a drive motor mounted within the hand grip through an elongated drive linkage extending from the hand grip into the applicator head. Thus, this patent is not intended to incorporate the drive motor in the applicator head itself.

SUMMARY OF THE INVENTION

The present invention eliminates the above-mentioned problem and provides an improved hand-held vibratory massager with dynamically balanced feature. A hand-held vibratory massager in accordance with the present invention comprises an elongated hand grip and a self-contained applicator head effecting vibration. The applicator head is resiliently connected to one longitudinal end of the hand grip by means of a resilient coupling member for limited movement in substantially all directions relative to the hand grip such that the applicator head is permitted to move with respect to the hand grip into an optimum angular position for achieving effective massaging action while maintaining the hand grip in a position for easy and comfortable manipulation. A drive motor is mounted within the applicator head with its output shaft defining a center axis of the applicator head. Carried on the motor output shaft is an eccentric flyweight which is spaced away from the substantial portion of the motor along the center axis and provides a vibratory motion to the applicator head upon rotation of the motor output shaft. The characterizing feature of the present invention resides in that a counterbalancing means is mounted within the applicator head in such a way as to align the center of mass of the entire applicator head with the center of mass of the eccentric flyweight on a plane perpendicular to the center axis of the applicator head. With this counterbalancing means, the applicator head can be dynamically balanced so that no counter shaking movement can be transmitted back to the hand grip, thus making the hand grip free from such undesired shaking movement, while enabling the applicator head to be resiliently flexed into an optimum massaging position.

Accordingly, it is a primary object of the present invention to provide a dynamically balanced vibratory massager which is capable of resiliently flexing the self-contained applicator head into an optimum massaging position without causing any counter shaking action to be transmitted back to the hand grip and therefore producing any serious fatigue of the user's hand grasping the hand grip.

In a preferred embodiment, the counterbalancing means comprises a counterweight mounted within the applicator head in such a relation that the motor, the eccentric flyweight, and the counterweight are aligned in this order in the axial direction of applicator head. The applicator head is formed at its external top end with a convexedly shaped face which formes inside thereof a concave recess for receiving the counterweight. The convex end face of the applicator head is generally perpendicular to the axis of the motor output shaft and is driven to move in a circular path within a plane perpendicular to the center axis so that it applies a rubbing massage action to a portion of the body against which it is placed. By better utilization of the concave portion formed inside of the convexedly shaped end face serving as the rubbing massage section, the counterweight is received within the applicator head in axially spaced relation from the flyweight within a limited axial dimension of the applicator head.

It is therefore another object of the present invention to provide a dynamically balanced vibratory massager in which the counterweight is properly mounted within the applicator head.

These and still other objects and advantages will become more apparent from the following detailed description of the preferred embodiment when taken in conjunction with the attached drawings.

DETAILED DESCRIPTION OF THE PREFERRED EMBODIMENT

Figure 1:
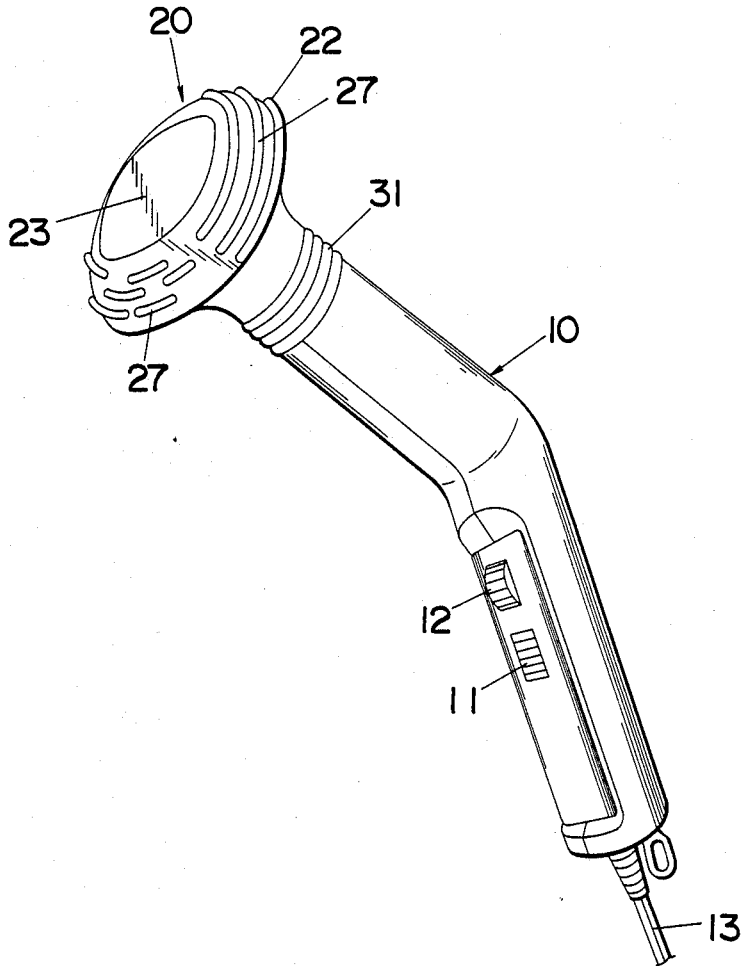
FIG. 1 is a perspective view of a hand-held vibratory massager in accordance with a preferred embodiment of the present invention.

Referring to FIG. 1, a hand-held vibratory massager in accordance with a preferred embodiment of the present invention is shown to be composed of an elongated hand grip 10 and an applicator head 20 which are resiliently coupled or connected by means of a coil spring 30. The hand grip 10 is a hollow tube provided with a main switch handle 11 and a control dial 12 10 for adjusting the rate of vibration effected by the applicator head 20. A power cord 13 extends from the rear end of the hand grip 10 for energization of an electric motor 40 mounted within the applicator head 20.

Figure 2:
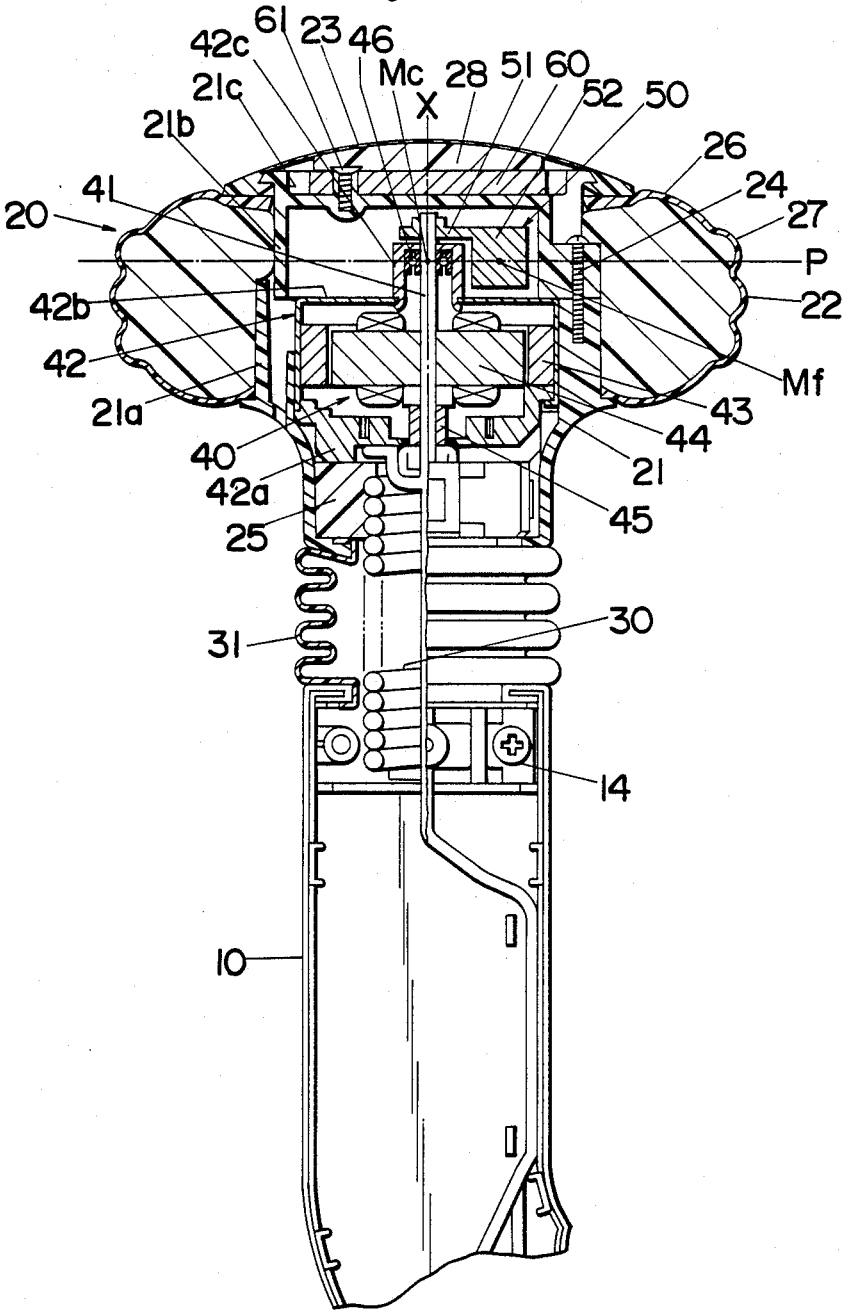
FIG. 2 is a sectional view of an applicator head and the portion of a hand grip composing the vibratory massager.

As shown in FIG. 2, the applicator head 20 comprises a core barrel 21, a cushioning annulus 22 surrounding the barrel 21, and a convexedly shaped end plate 23 covering the top face of the barrel 21. The core barrel 21 is composed of a base member **21*a* and a top member 21*b* secured together by means of screws 24 (only one of which is seen in the figure). The motor 40 is mounted within the core barrel 21 together with a flyweight 50 so that the applicator head 20 is made as a self-contained vibration-generating unit. Fixed in the narrow end of the base member 21*a* is a ring 25 on which the motor 40 is supported with its output shaft 41 extending in coaxial alignment with a center axis X of the applicator head 20. The motor 40 includes a casing 42 composed of a base plate 42*a* secured to the ring 25 and a cylindrical cover 42*b* surrounding a stator 43 and a rotor 44. The output shaft 41 carried by the rotor 44 is journaled at its longitudinal ends respectively by bearings 45 and 46, one at the base plate 42*a* and the other at an extension bracket 42*c* on the top center of the cylindrical cover 42*b*. The eccentric flyweight 50 is connected to the exposed end of the output shaft 41 by a stem 51 in such a way that a major portion 52 thereof rotates around the extension bracket 42*c* upon rotation of the output 10 shaft 41 for producing vibrations transverse to the axis of the output shaft 41 or the center axis X of the applicator head 20**.

One end of the coil spring coupling member 30 extends into the ring 25 of the applicator head 20 and is threadedly engaged therewith, while the other end of the coil spring coupling member 30 extends into the end of the hand grip 10 where it is secured by means of a clamp member 14. A corrugated cover 31 surrounds the coil spring 30 between the applicator head 20 and the hand grip 10 with its opposite ends connected respectively to the applicator head 20 and the hand grip 10. This resilient coupling permits the applicator head 20 to move substantially in all directions with respect to the hand grip 10 in a limited extent, so that the applicator head 20 can be brought into an optimum angular position with respect to the hand grip 10 during the massaging treatment, assuring an effective massage treatment with the hand grip 10 supported by the user at a comfortable position.

The annulus 22 of the applicator head 20 is made of a cushioning material, for example, foamed polyethylene covered by a soft shell 26 which is connected at its inner ends to the core barrel 21 and is formed on its exterior with a number of circumferentially extending ribs 27. The side face of the annulus 22 including the ribs 27 serves to apply a tapping massage effect upon a selected body portion against which it is placed. The convexedly shaped end plate 23 is made of relatively hard plastic material and extends over a cushioning material 28 with its peripheral end hooked to the end of the top member **21*b*. The end plate 23 provides a convexly shaped massaging end face and cooperates with the cushioning material 28 to apply a rubbing massage effect upon the body portion as the applicator head 20** vibrates.

Figure 3:
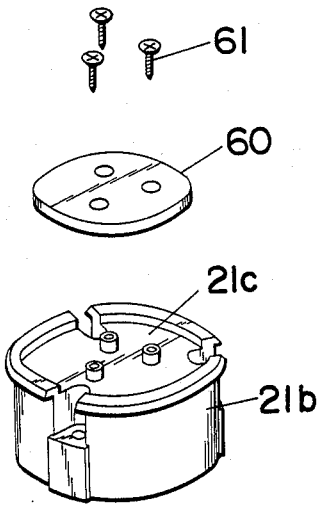
FIG. 3 is a perspective view of a portion of the applicator head and a counterweight held thereby.
Figure 4A:
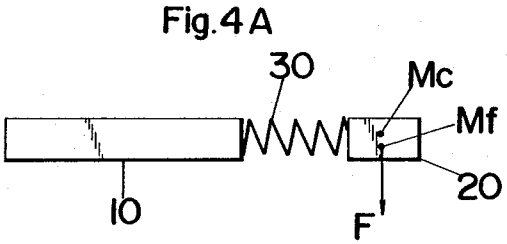
FIGS. 4A and 4B are diagrams schematically illustrating the characterizing feature of the present inventions, respectively.
Figure 4B:
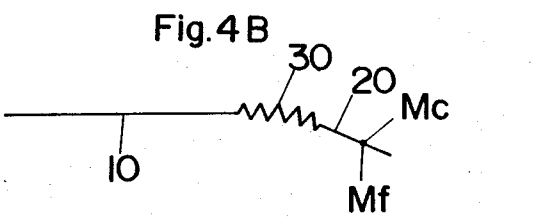
Figure 5A:
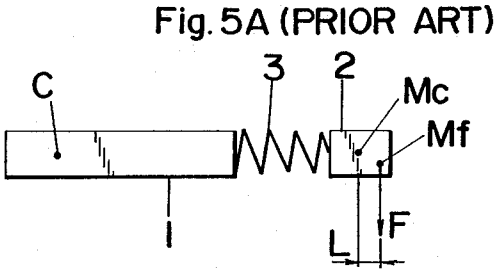
Fig.5A (PRIOR ART)
FIGS. 5A and 5B are diagrams schematically illustrating the feature and problem of a prior vibratory massager.
Figure 5B:
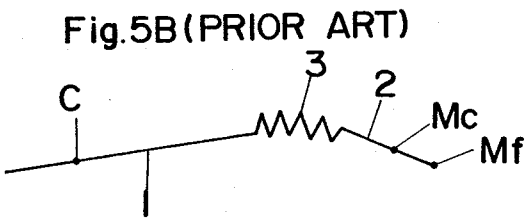
Fig.5B (PRIOR ART)
Figure 6A:
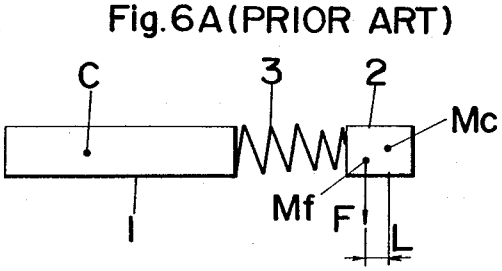
Fig.6A (PRIOR ART)
FIGS. 6A and 6B are diagrams schematically illustrating the feature and problem of another vibratory massager simply introduced in comparison with the present invention.
Figure 6B:
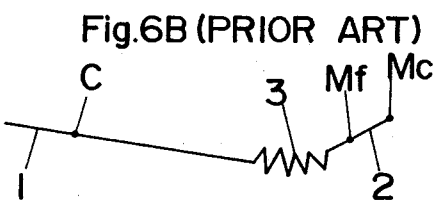
Fig.6B (PRIOR ART)

Mounted within the applicator head 20 is a counter blancing means in the form of a counterweight 60 which is offset from the motor 40 and the flyweight 50 along the center axis X in order to provide dynamic balancing of the applicator head 20. The counterweight 60 is in the form of circular metal plate which is mounted coaxially within a shallow sink **21*c* in the end of the top member 21*b* and is secured thereto by means of screws 61, as best shown in FIG. 3. And this counterweight 60 is received together with the cushioning material 28 within a concave recess formed inside of the convexedly shaped end plate 23. It is this counterweight 60 that acts to align the mass center Mc of the entire applicator head 20 including the motor 40 and resiliently supported by the coil spring 30 with the mass center Mf of the flyweight 50 in a plane perpendicular to the center axis X of the applicator head 20. That is, the mass center Mc of the entire applicator head 20 and the mass center Mf of the flyweight 50 are aligned in a same plane P perpendicular to the center axis X of the applicator head 20, as indicated in FIG. 2. In other words, when the flyweight 50 is rotating, the mass center Mc of the entire applicator head 20 comes on the center axis X in coincidence with the center of rotation of the mass center Mf of the flyweight 50. The effect of dynamically balancing the applicator head 20 will be discussed with reference to FIGS. 4A and 4B. Since the mass center Mc of the applicator head 20 and the mass center Mf of the flyweight are aligned on plane P there is no axial displacement between Mc and Mf, force F produced at the rotating flyweight 50 acts only to vibrate the applicator head 20 and will never cause any substantial torque about the mass center Mc of the entire applicator head 20, leaving the hand grip 10 free from any reaction shaking which would otherwise result from such torque developed as in the prior massager of FIGS. 5A and 5B, 6A and 6B. Thus, the hand grip 10 can be kept rather intact during the massaging treatment, whereby the user can enjoy the massaging effect for an extended time without suffering such reaction shaking or irritating jerky movement. It is to be noted at this time that the bearing 46 is utilized to support the output shaft 41 at a point which coincides with the center of rotation of the mass center Mf of the flyweight 50 for stably and effectively supporting the output shaft 41 against the vibration of the flyweight 50. Further, the counterweight 60 of rigid material serves to back up the cushioning material 28 over the entire area thereof in order to give a proper cushioning characteristic to the tapping massage section at the top end face of the applicator head 20**.

What is claimed is:

1. A hand-held vibratory massager which comprises:

an elongated hand grip;

an applicator head resiliently connected to one longitudinal end of the hand grip by means of a resilient coupling member for limited movement in substantially all directions relative to the hand grip;

a drive motor mounted within the applicator head, said drive motor having an output shaft which defines a center axis of said applicator head;

an eccentric flyweight carried on the output shaft of said motor in eccentric relation thereto for providing a vibratory motion to said applicator head upon rotation of said output shaft;

wherein the improvement comprises:

a counterweight mounted within said applicator head to align the center of mass of the entire applicator head with the center of the mass of said eccentric flyweight on a plane perpendicular to said center axis of said applicator head; and said counterweight is disposed within said applicator head in such a relation that the motor, the eccentric flyweight, and the counterweight are aligned in that order in the axial direction of said applicator head.

2. A hand-held vibratory massager as set forth in claim 1, wherein said applicator head is formed at one end with a convexedly shaped massaging face and said counterweight is axially spaced from said flyweight and received within a concave recess formed inside said convexedly shaped massaging face at said one end of said applicator head.

* * * * *